US011300279B2

(12) United States Patent
Cacciabeve

(10) Patent No.: US 11,300,279 B2
(45) Date of Patent: Apr. 12, 2022

(54) PORTABLE LIGHT

(71) Applicant: Walter R. Tucker Enterprises, Ltd., Deposit, NY (US)

(72) Inventor: Robert Cacciabeve, Boonton, NJ (US)

(73) Assignee: Walter R. Tucker Enterprises, Ltd., Deposit, NY (US)

( * ) Notice: Subject to any disclaimer, the term of this patent is extended or adjusted under 35 U.S.C. 154(b) by 0 days.

(21) Appl. No.: 17/018,483

(22) Filed: Sep. 11, 2020

(65) Prior Publication Data

US 2020/0408389 A1 Dec. 31, 2020

Related U.S. Application Data

(63) Continuation-in-part of application No. 29/274,233, filed on Apr. 6, 2007, now Pat. No. Des. 561,890, and a continuation-in-part of application No. 16/860,590, filed on Apr. 28, 2020, now Pat. No. 10,900,647, which is a continuation of application No. 16/426,382, filed on May 30, 2019, now Pat. No. 10,677,431, which is a continuation-in-part of (Continued)

(51) Int. Cl.

| | |
|---|---|
| ***F21V 21/14*** | (2006.01) |
| ***F21L 4/02*** | (2006.01) |
| ***F21V 21/096*** | (2006.01) |
| ***F21V 21/26*** | (2006.01) |
| ***F21L 4/08*** | (2006.01) |
| ***F21V 21/32*** | (2006.01) |
| ***F21Y 115/10*** | (2016.01) |

(52) U.S. Cl.

CPC ..... *F21V 21/145* (2013.01); *F21L 4/02* (2013.01); *F21L 4/08* (2013.01); *F21V 21/0965* (2013.01); *F21V 21/26* (2013.01); *F21V 21/32* (2013.01); *F21Y 2115/10* (2016.08)

(58) Field of Classification Search

CPC .... F21V 21/32; F21V 21/0965; F21V 21/145; F21V 21/26; F21V 21/30; F21L 4/06

See application file for complete search history.

(56) References Cited

U.S. PATENT DOCUMENTS 3,962,678 A * 6/1976 Kurokawa ..... F16M 11/40 362/275

D268,442 S 3/1983 Darmon (Continued)

FOREIGN PATENT DOCUMENTS

CN 201661949 U 12/2010
CN 201916829 U 8/2011

(Continued)

OTHER PUBLICATIONS

Multifunction 24 LED Long Range Flexible Snake Light Flashlight, SKU# ZP3051000711006, https://www.zapals.com, 3 pages, Jan. 4, 2019.

(Continued)

*Primary Examiner* — William N Harris

(74) *Attorney, Agent, or Firm* — Breiner & Breiner, L.L.C.

(57) ABSTRACT

A portable light for attaching to an object or wearing on a user's neck is disclosed having a flexible member adapted to be attached to the object or to fit around a user's neck, body members at each end of the flexible member each having a light source, a power source and an on/off switch.

17 Claims, 10 Drawing Sheets

Related U.S. Application Data application No. 29/665,892, filed on Oct. 8, 2018, now Pat. No. Des. 871,636, and a continuation-in-part of application No. 29/665,881, filed on Oct. 8, 2018, now Pat. No. Des. 871,257.

(60) Provisional application No. 62/899,276, filed on Sep. 12, 2019, provisional application No. 62/743,327, filed on Oct. 9, 2018.

(56) References Cited

U.S. PATENT DOCUMENTS

| | | | | |
|---|---|---|---|---|
| 4,495,550 | A | 1/1985 | Visciano | |
| D306,351 | S | 2/1990 | Charet et al. | |
| 5,268,826 | A | 12/1993 | Greene | |
| 5,385,500 | A | 1/1995 | Schmidt | |
| D365,646 | S | 12/1995 | deBlois | |
| D368,146 | S | 3/1996 | Carbone | |
| D369,873 | S | 5/1996 | deBlois et al. | |
| D370,988 | S | 6/1996 | Santarsiero | |
| D371,855 | S | 7/1996 | Heun | |
| D373,651 | S | 9/1996 | Szymanski | |
| D374,299 | S | 10/1996 | Carbone | |
| 5,571,279 | A * | 11/1996 | Chiang | F21L 4/04 362/157 |
| D385,371 | S | 10/1997 | Yemini | |
| 5,707,137 | A | 1/1998 | Hon | |
| 5,717,276 | A | 2/1998 | Hsu | |
| 5,749,644 | A * | 5/1998 | Carbone | F21V 21/145 362/194 |
| 5,765,938 | A | 6/1998 | Rousso et al. | |
| 5,791,763 | A | 8/1998 | Kam-Hoi | |
| D408,566 | S | 4/1999 | Welsh et al. | |
| 5,944,407 | A * | 8/1999 | Lynch | F21V 21/32 362/198 |
| 6,004,004 | A | 12/1999 | Altman et al. | |
| 6,280,050 | B1 * | 8/2001 | Bird | F21V 21/32 362/191 |
| 6,641,279 | B1 | 11/2003 | Williams | |
| 6,680,844 | B2 | 1/2004 | Kim | |
| 6,866,395 | B2 | 3/2005 | Phipps et al. | |
| 6,874,908 | B2 | 4/2005 | Sharrah et al. | |
| D536,116 | S | 1/2007 | Sharrah | |
| 7,175,295 | B2 * | 2/2007 | Bretz | F21L 2/00 362/108 |
| D571,942 | S | 6/2008 | Christianson | |
| D623,783 | S | 9/2010 | Christianson et al. | |
| 8,210,704 | B1 | 7/2012 | Parsons | |
| D699,875 | S | 2/2014 | Christianson et al. | |
| 8,715,328 | B2 | 5/2014 | Gerardo | |
| D768,024 | S | 10/2016 | Dayal et al. | |
| 9,534,752 | B1 | 1/2017 | Mishan | |
| 9,546,779 | B2 | 1/2017 | Rementer | |
| 9,677,901 | B2 | 6/2017 | Yamamoto | |
| D804,070 | S | 11/2017 | Mishan | |
| D835,314 | S | 12/2018 | Sun | |
| D871,257 | S | 12/2019 | Cacciabeve | |
| D871,636 | S | 12/2019 | Cacciabeve | |
| 10,677,431 | B2 | 6/2020 | Cacciabeve | |
| 2003/0067771 | A1 | 4/2003 | Kung | |
| 2003/0161143 | A1 | 8/2003 | Parker et al. | |
| 2003/0189824 | A1 | 10/2003 | Meeder et al. | |
| 2006/0176680 | A1 | 8/2006 | Bretz et al. | |
| 2017/0102131 | A1 | 4/2017 | Chen | |
| 2017/0138585 | A1 | 5/2017 | Korenek et al. | |
| 2018/0231234 | A1 | 8/2018 | Bian | |

FOREIGN PATENT DOCUMENTS

| | | | |
|---|---|---|---|
| CN | 203363701 | U | 12/2013 |
| CN | 106764575 | A | 5/2017 |
| EP | 2146136 | A1 | 1/2010 |
| EP | 2740988 | A1 | 6/2014 |
| WO | 2017126512 | A1 | 7/2017 |

OTHER PUBLICATIONS

MyLight HL000002 HUGlight Pro LED Hands Free Magnetic Task Light by My Light, https://www.amazon.com. 1 page, Jan. 4, 2019.

My Light Hug Light LED Hands-Free Flexible Book Light by My Light, https://www.amazon.com, 8 pages, Jan. 4, 2019.

* cited by examiner

PORTABLE LIGHT

RELATED APPLICATIONS

This application claims benefit of U.S. Provisional Application Ser. No. 62/899,276, filed Sep. 12, 2019, entitled "Portable Light," and is a continuation-in-part of U.S. patent application Ser. No. 29/724,233, filed Feb. 13, 2020, entitled "Portable Light," and is a continuation-inpart of U.S. application Ser. No. 16/860,590, filed Apr. 28, 2020, entitled "Portable Light," and which latter application claims benefit of U.S. application Ser. No. 16/426,382, filed May 30, 2019, entitled "Portable Light," now U.S. Pat. No. 10,677,431, and which latter application claimed benefit of U.S. Provisional Application 62/743,327, filed on Oct. 9, 2018, entitled "Portable Light," and U.S. application Ser. No. 16/426,382 was a continuation-in-part of U.S. application Ser. Nos. 29/665,892 and 29/665,881, both filed Oct. 8, 2018, and both entitled "Portable Light," now U.S. Pat. Nos. D871,636 and D871,257, respectively, all of which aforesaid applications and patents are incorporated herein by reference in their entireties.

FIELD OF THE INVENTION

The present invention relates to a portable light. More particularly, the invention relates to a portable light with a flexible member having a body member at each end with a light source and which portable light may be attached to an object or worn on a user's neck and the flexible member allows for adjustment of the light sources to focus the light sources on an environment of use.

BACKGROUND OF THE INVENTION

Portable lights are known for use in various situations, including working on an automobile, working in the home and recreational uses. In such instances, there may not be an adequate amount of light; the user may require hands free lighting; the user may need to focus the light on the specific area being worked on; or similar issues.

Various types of portable lights are known in the art. While these devices may provide one or more of the desired attributes, including as set forth above, these devices have various shortcomings and may not meet the needs of a user of a portable light. These and other shortcomings of the known portable lights are addressed by the present invention.

SUMMARY OF THE INVENTION

A primary object of the present invention is to provide a portable light having a flexible member having a body member at each end with a light source and which portable light may be attached to an object or worn on a user's neck and the flexible member allows for adjustment of the light sources to focus the light sources on an environment of use.

Another primary object of the invention is to provide a portable light having a flexible member comprising a flexible wire surrounded by a metal coil with an over-molded elastomeric member allowing the light to be wrapped around tight radiuses and worn comfortably around a user's neck.

Another primary object of the invention is to provide a portable neck light having a flexible member with an over-molded elastomeric body. The over-molded elastomeric body is soft and flexible to the touch, and the light may be comfortably worn around the neck of a user. The over-molded body has soft thin ribs which provide an extra grip to the surfaces it is being wrapped around, i.e. the soft thin ribs are sufficiently flexible to conform and grip to most any shape.

Another primary object of the invention is to provide a portable light having a single battery located in a body member at one end of the light. The power is supplied through the flexible member to the other end of the light. This provides versatility to the portable light because the light may be tightly wrapped around smaller radiuses than if it were to have the battery in the center of the light. A flexible wire surrounded by a metal coil runs through the flexible member giving the light more stability and memory, thereby preventing any recoil.

Another primary object of the invention is to provide a portable light having connection members in the body members to attach the body members to each other when storing the light away, thereby making the light more compact when not being used.

Another primary object of the invention is to provide a portable light having an additional light source in a side of a body member, e.g. functioning as a flood light.

Another primary object of the invention is to provide a portable light which is battery operated and rechargeable through a USB port, wherein the battery is at one end of the light and powers all light sources of the portable light. There is one switch which controls the light sources at each end of the light and a separate switch to control any additional light source.

Another primary object of the invention is to provide a portable light which provides hands free lighting for work, recreation or other activities.

The invention is directed to a portable light for attaching to an object or wearing on a person comprising a flexible member adapted to be attached to an object or fit around the user's neck and having a first end and second end; a first body member having at least one light source attached at the first end of the flexible member; a second body member having at least one light source attached at the second end of the flexible member; the flexible member comprising a flexible wire which may be surrounded by a flexible metal coil which is over-molded with a soft-flexible material having a plurality of soft ribs; a power source in one of the first or second body members; and at least one switch on one of the first or second members adapted to turn the light sources on and off.

These primary and other objects of the invention will be apparent from the following description of the preferred embodiments of the invention and from the accompanying drawings.

BRIEF DESCRIPTION OF THE DRAWINGS

The following detailed description of the specific non-limiting embodiments of the present invention can be best understood when read in conjunction with the following drawings, where like structures are indicated by like reference numbers.

Referring to the drawings.

DETAILED DESCRIPTION OF THE PREFERRED EMBODIMENTS

Figure 1:
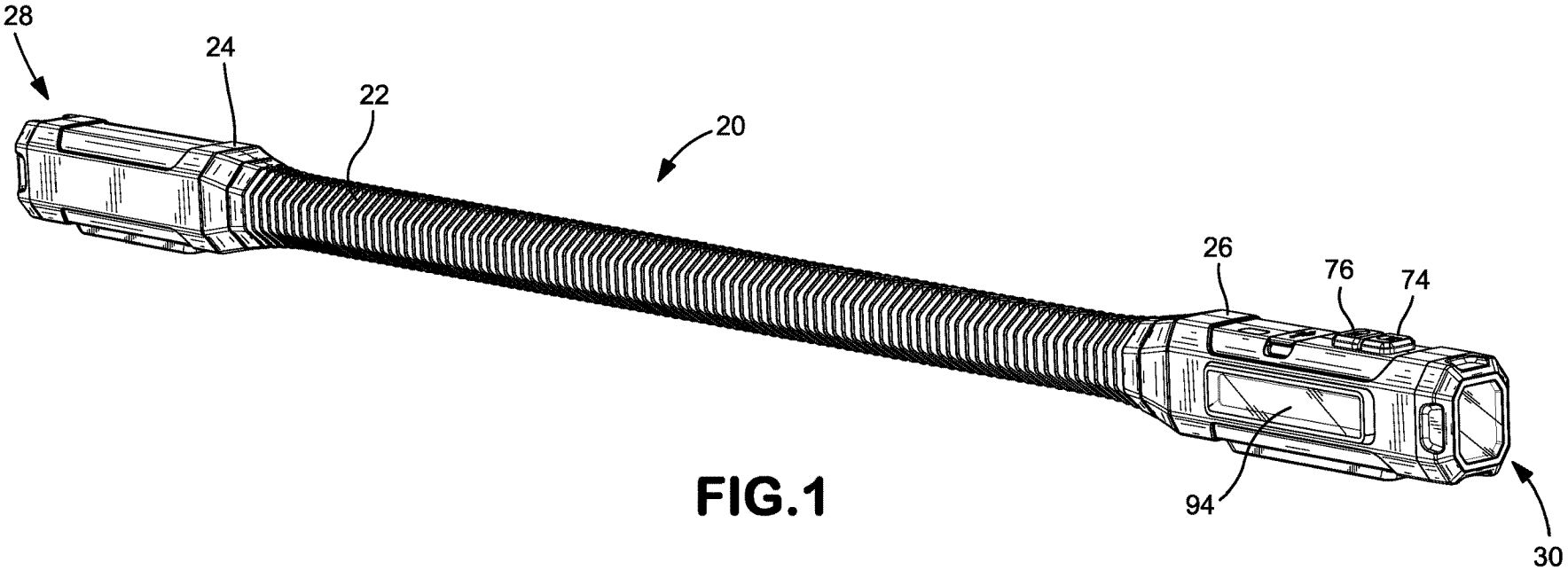
FIG. 1 is a front/side elevational perspective view of the portable light.
Figure 2:
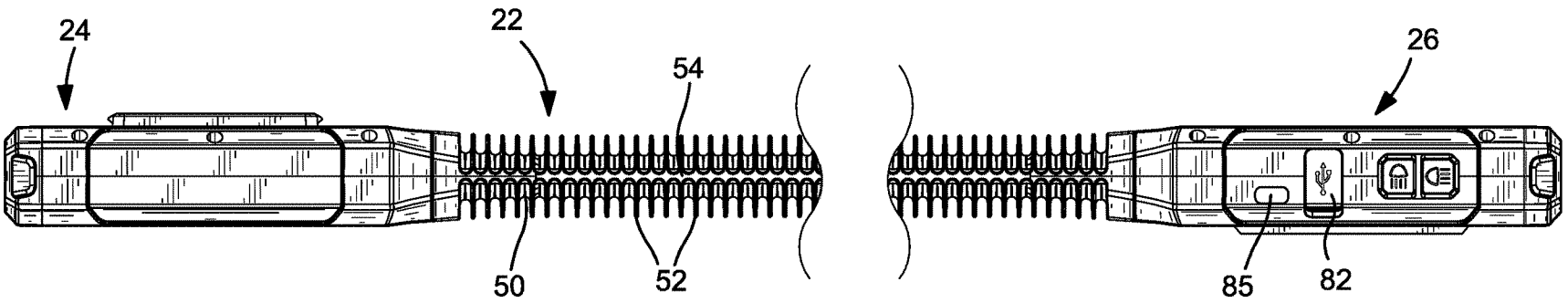
FIG. 2 is a top view of the portable light.
Figure 3:
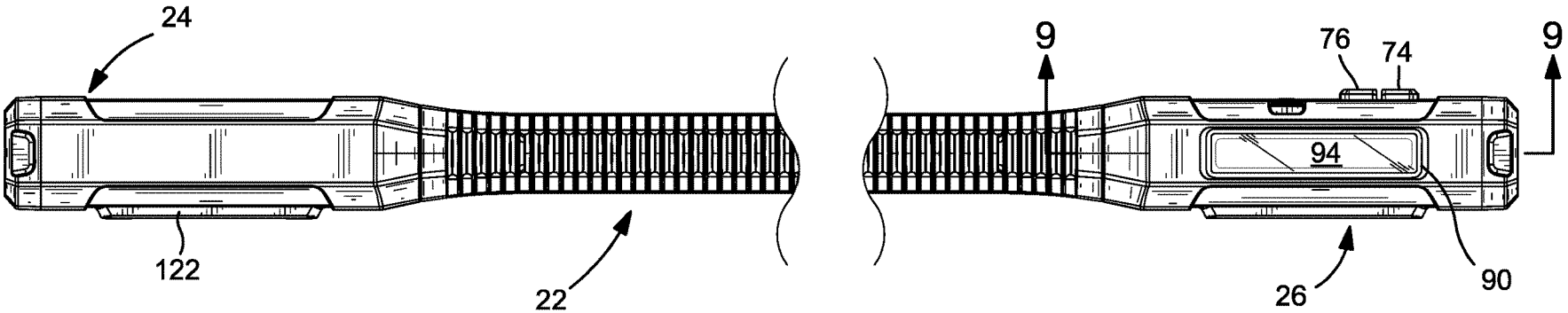
FIG. 3 is a first side view of the portable light.
Figure 4:
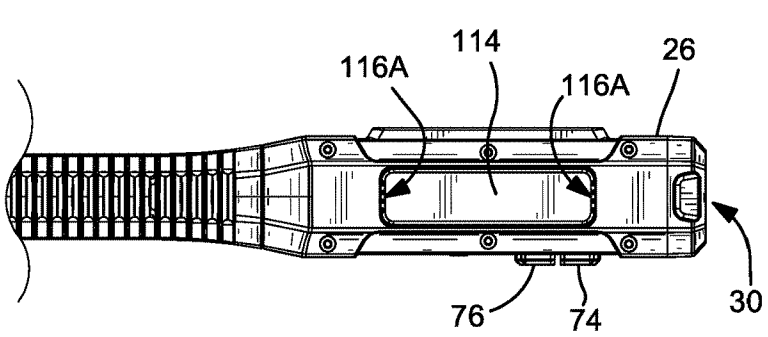
FIG. 4 is a second side view of the portable light.
Figure 5:
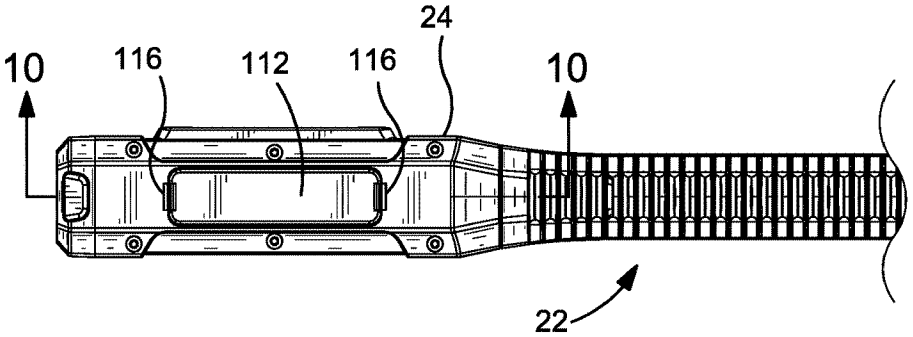
FIG. 5 is a bottom view of the portable light.
Figure 5:
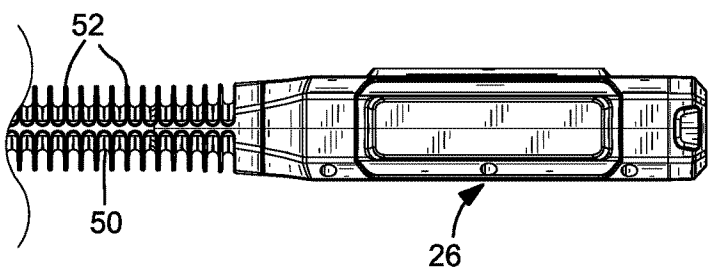
Figure 7:
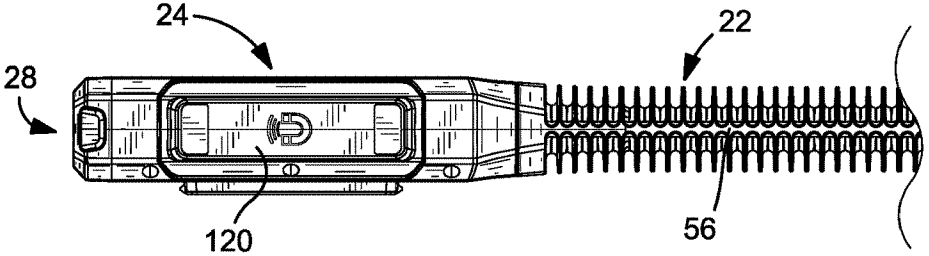
FIG. 7 is a second end view of the portable light.
Figure 7:
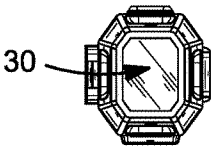
Figure 6:
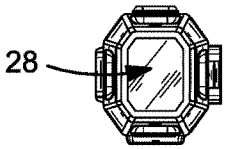
FIG. 6 is a first end view of the portable light.

The present invention is directed to a portable light having a flexible member. The portable light may be attached to an object or may be wearable around a user's neck. There is a light source at each end of the portable light to provide the necessary illumination to an area of interest such as in an automotive garage or a work area in the home or for recreational purposes such as camping or reading. The portable light of the present invention includes a flexible member adapted to be attached to an object or to fit around a user's neck and body members at each end of the flexible member having a light source. There may be an additional light source, e.g. a flood light, in one of the body members. The flexible member allows each body member to be adjusted to focus each light source independently of the other. There is a power source in one body member to power the light sources and controlled by at least one on/off switch.

Referring to the Figures, there is shown a portable light 20. The portable light 20 includes a flexible member 22, body members 24 and 26, light sources 28 and 30, and switches 74 and 76. The portable light 20 will now be discussed in further detail.

Figure 8:
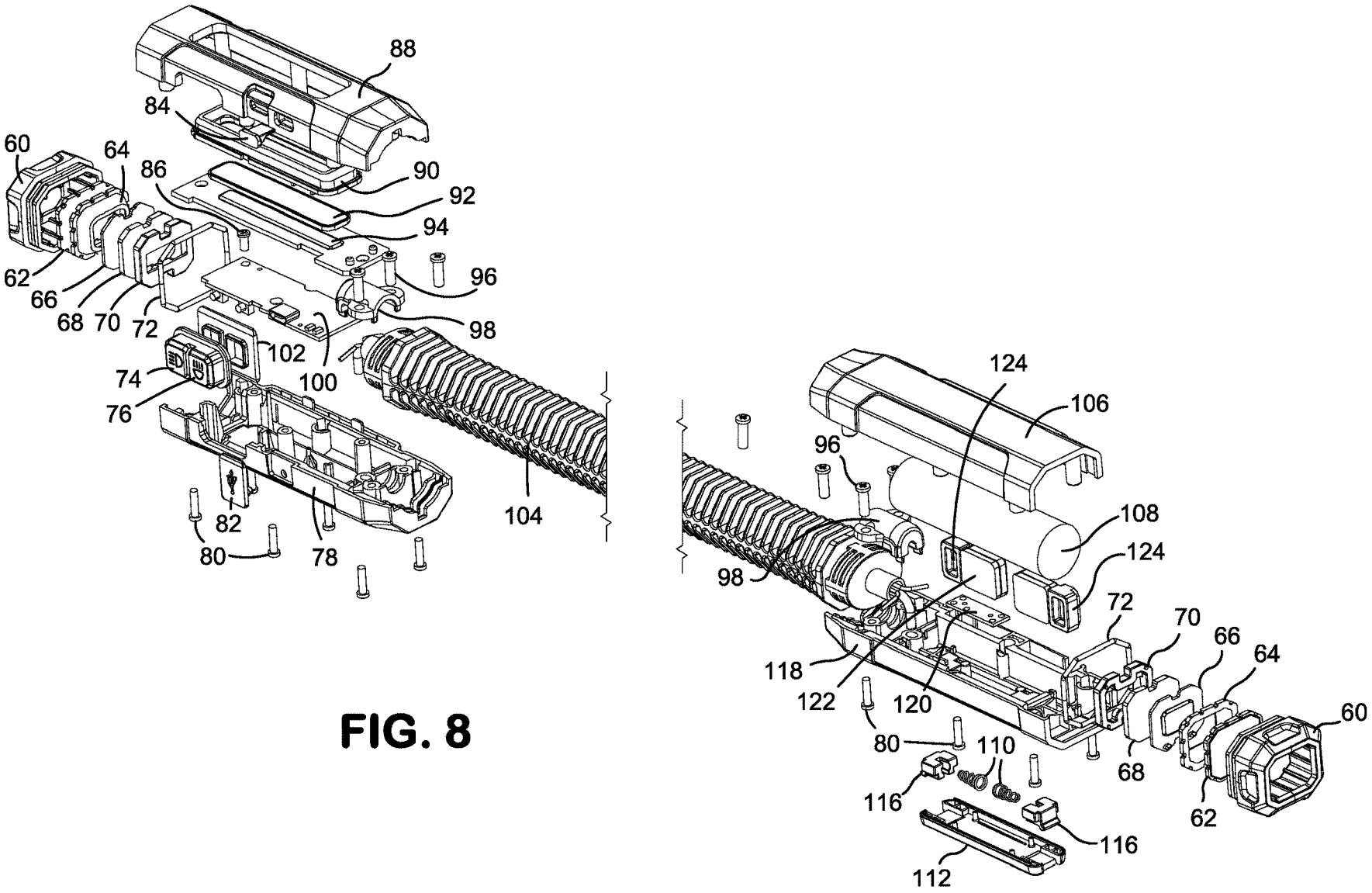
FIG. 8 is an exploded view of the portable light.
Figure 9:
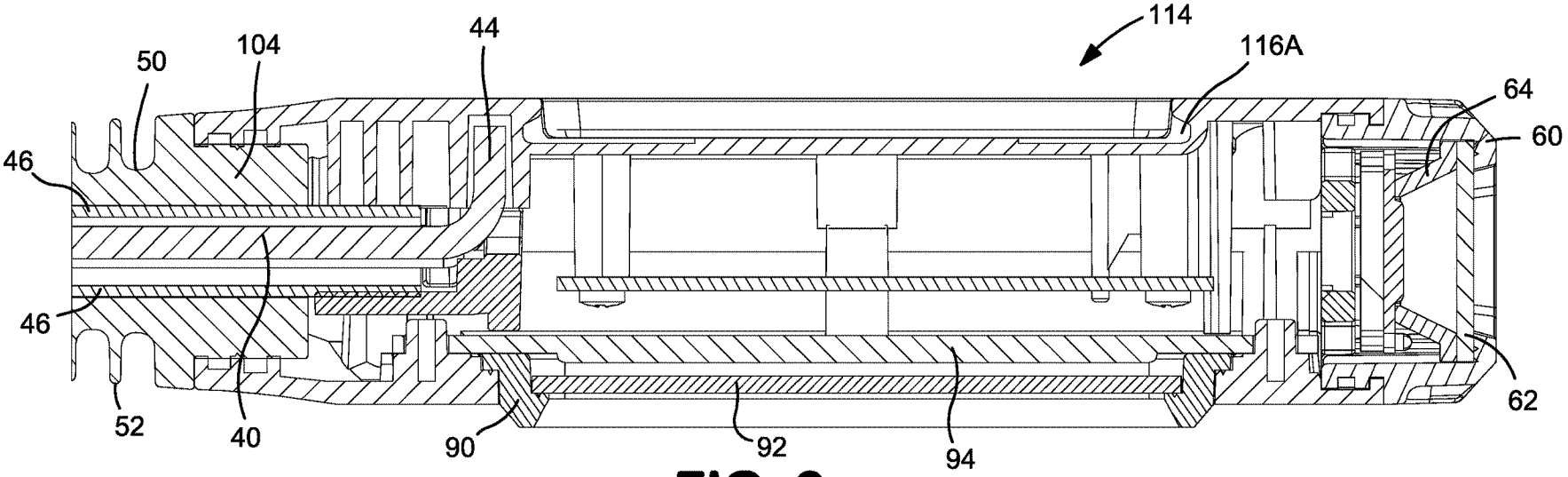
FIG. 9 is a cross-sectional view taken along line 9-9 of FIG. 3 showing a second end of the portable light.
Figure 10:
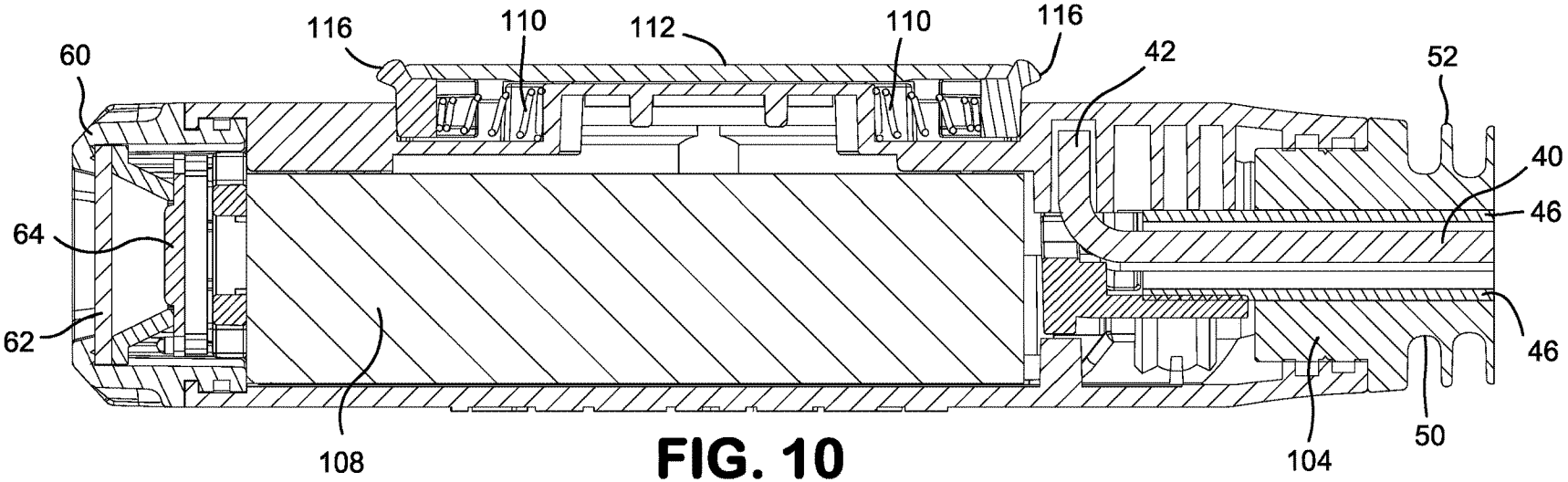
FIG. 10 is a cross-sectional view taken along line 10-10 of FIG. 4 showing a first end of the portable light.
Figure 11:
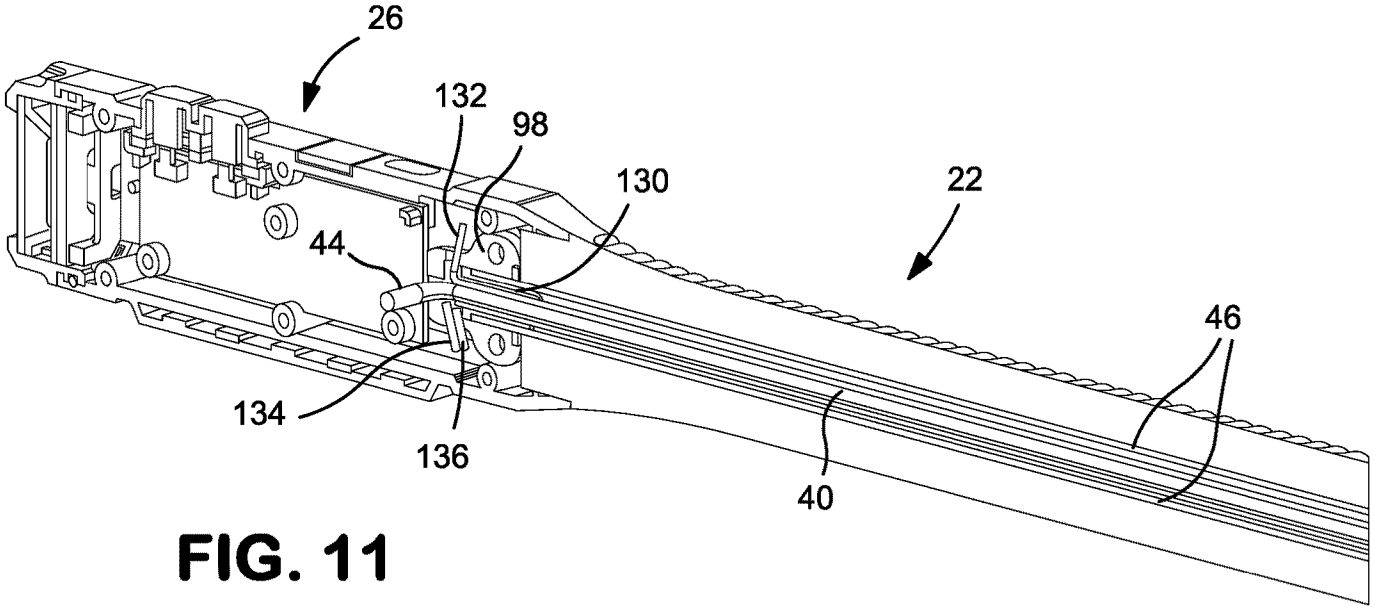
FIG. 11 is a partial cross-sectional view of the second end of the portable light.
Figure 12:
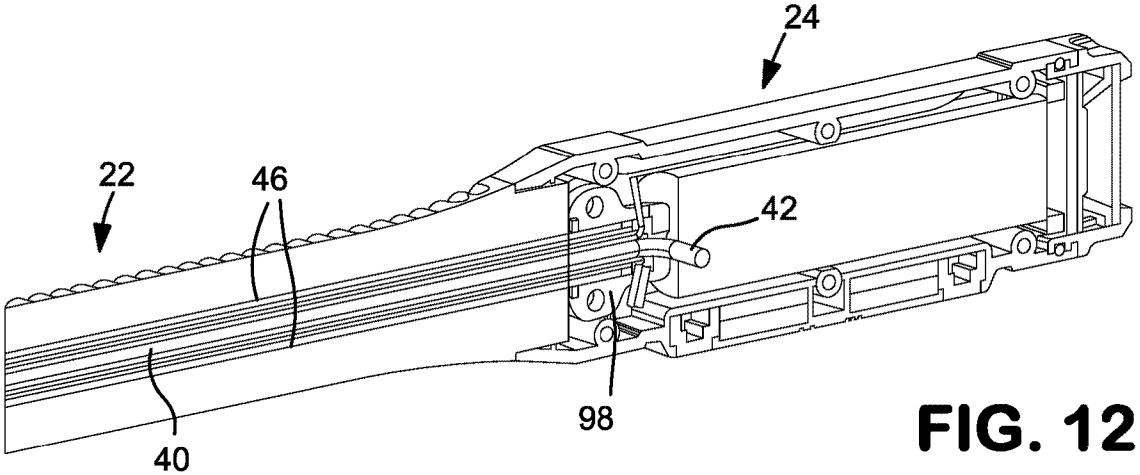
FIG. 12 is a partial cross-sectional view of the first end of the portable light.
Figure 13:
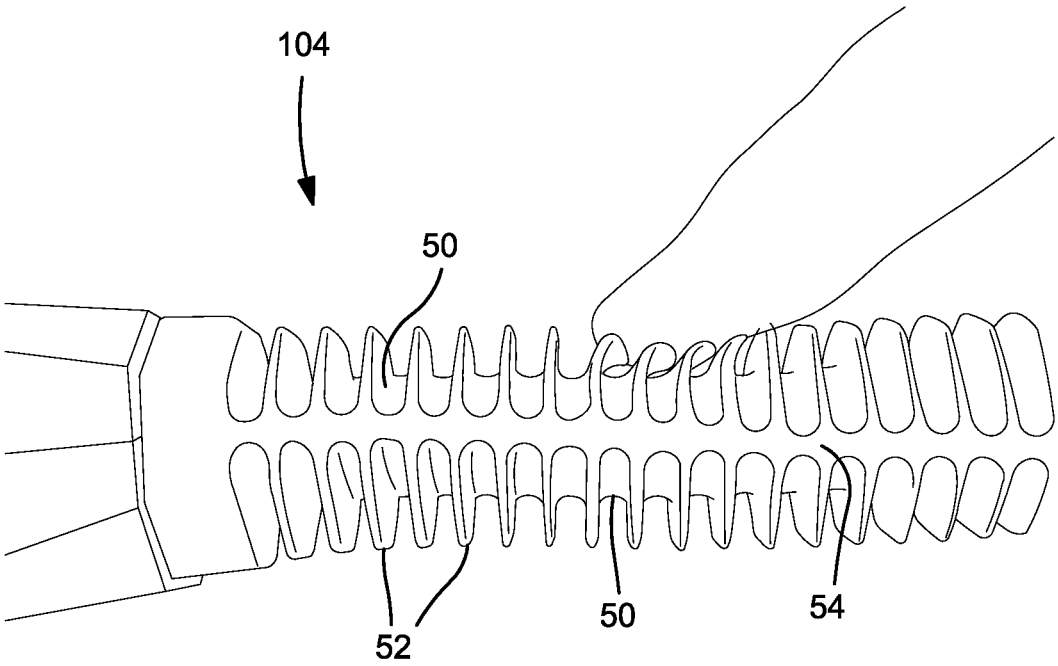
FIG. 13 is an enlarged view of the flexible member of the portable light and illustrating the soft flexible ribs of the flexible member.

Referring to FIG. 8, there is shown an exploded view of the portable light 20 and includes components of the portable light 20 as follows:

#60 LENS CAP
#62 LENS
#64 REFLECTOR
#66 COB LIGHT
#68 HEAT SINK
#70 HEAT SINK HOLDER
#72 O-RING
#74,76 POWER SWITCHES
#78 INJECTION MOLDED SHELL A
#80 SCREW 1 (12)
#82 USB COVER
#84 USB CHARGE PORT
#86 SCREW 2 (2)
#88 INJECTION MOLDED SHELL B
#90 FLOOD LIGHT LENS COVER
#92 FLOOD LIGHT LENS
#94 COB LIGHT
#96 SCREW 3 (4)
#98 WIRE CAP
#100 PCB BOARD A
#102 SWITCH STOP
#104 FLEXIBLE ELASTOMERIC WIRE COVER
#106 INJECTION MOLDED SHELL C
#108 LITHIUM ION BATTERY
#110 SPRING
#112 SNAP FIT CLIP
#114 SNAP FIT CLIP RECEPTACLE
#116 SPRING LOADED DETENT
#118 INJECTION MOLDED SHELL D
#120 PCB BOARD B
#122 MAGNET
#124 NON-SLIP FEET/GRIP

Figure 15:
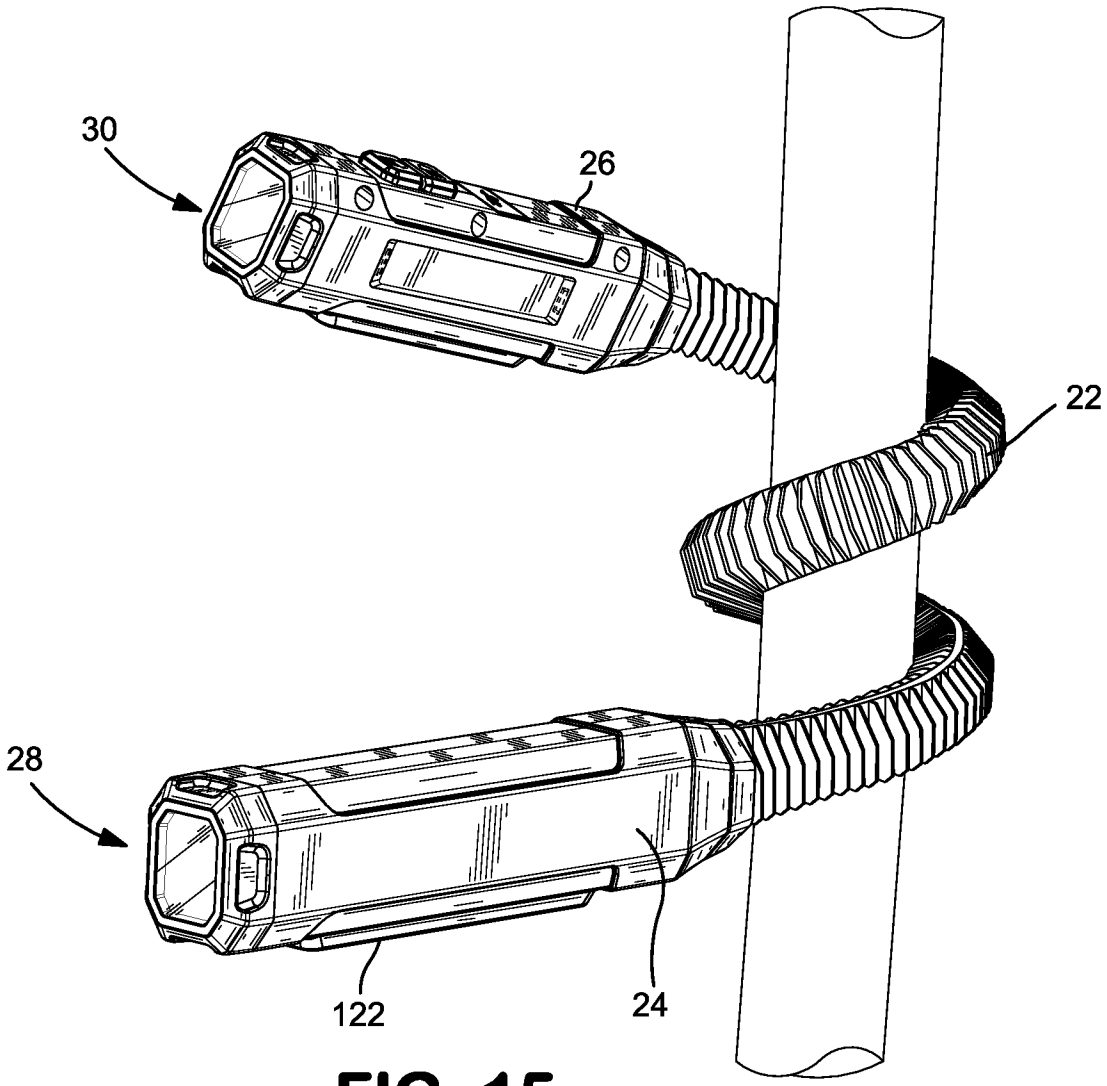
FIG. 15 illustrates the portable light in an environment of use.

The various components of the portable light 20 will now be discussed in further detail. Flexible member 22 is adapted to attach to an object as shown in FIG. 15 or to fit around a user's neck and may rest on the shirt collar, of the user or fit comfortably around the neck of the user. The light may also be self-standing by adjustment of the flexible member or may be hand carried to focus the light source(s).

Referring, for example, to FIGS. 9-13, the flexible member 22 comprises a flexible wire 40 having L-shaped ends 42,44 which attach to the housing of each body member 24 and 26. Surrounding structural wire 40 is a flexible sleeve 46 preferably constructed of a metal coil. Surrounding the flexible sleeve 46 and flexible wire 40 is a soft elastomeric material 104, e.g. silicone, having a tubular member 50 and extending from tubular member are a plurality of soft flexible ribs 52. Structural support spines 54 and 56 are provided to give support to ribs 52 and are preferably spaced 180 degrees from each other. Ribs 52 extend outward from tubular member 50.

Each body member 24 and 26 includes a COB (chips on board) LED light source. Each light source preferably provides 200 lumens of light. Body members 24 and 26 are a molded ABS plastic. Body member 24 includes housing members 106 and 118 and body member 26 includes housing members 78 and 88, these structures being held together by screws 80. Each body member 24 and 26 include the lighting components, including an LED COB light source 66, lens cap 60, lens 62, reflector 64, heat sink 68, heat sink holder 70 and O-ring 72.

Body member 26 further includes an LED COB light source 94 on the side of the body member to function as a flood light. The light source preferably provides 300 lumens of light. There is a lens cover 90 and lens 92.

Body members 24 and 26 further includes a wire cap 98 to anchor flexible wire 40 in each body member housing by screws 96. This will prevent rotation of the flexible wire.

Body member 24 includes a power source such as a rechargeable lithium ion battery 108 which powers the three light sources. There is a power wire bushing 130 at each end of the flexible member through which power wires 132, 134 and 136 run through connecting the power source 108 to each of the light sources. Body member 24 includes a PCB board 120 for controlling the light source in body member 24, and body member 26 includes a PCB board 100 for controlling the light sources in body member 26 and USB rechargeable port and recharging indicator. Body member 26 includes a USB rechargeable port 84 to charge battery 108 and which is covered by a USB port cover 82, preferably of a flexible elastomeric material. There may be a recharging indicator light 85 to indicate the charge level of the battery.

Body member 24 includes a magnet 120 for attaching light 20 to a metal object for a hands free light source. There are non-slip feet grips 124 to grip to the object and prevent scratching of the object.

Figure 14A:
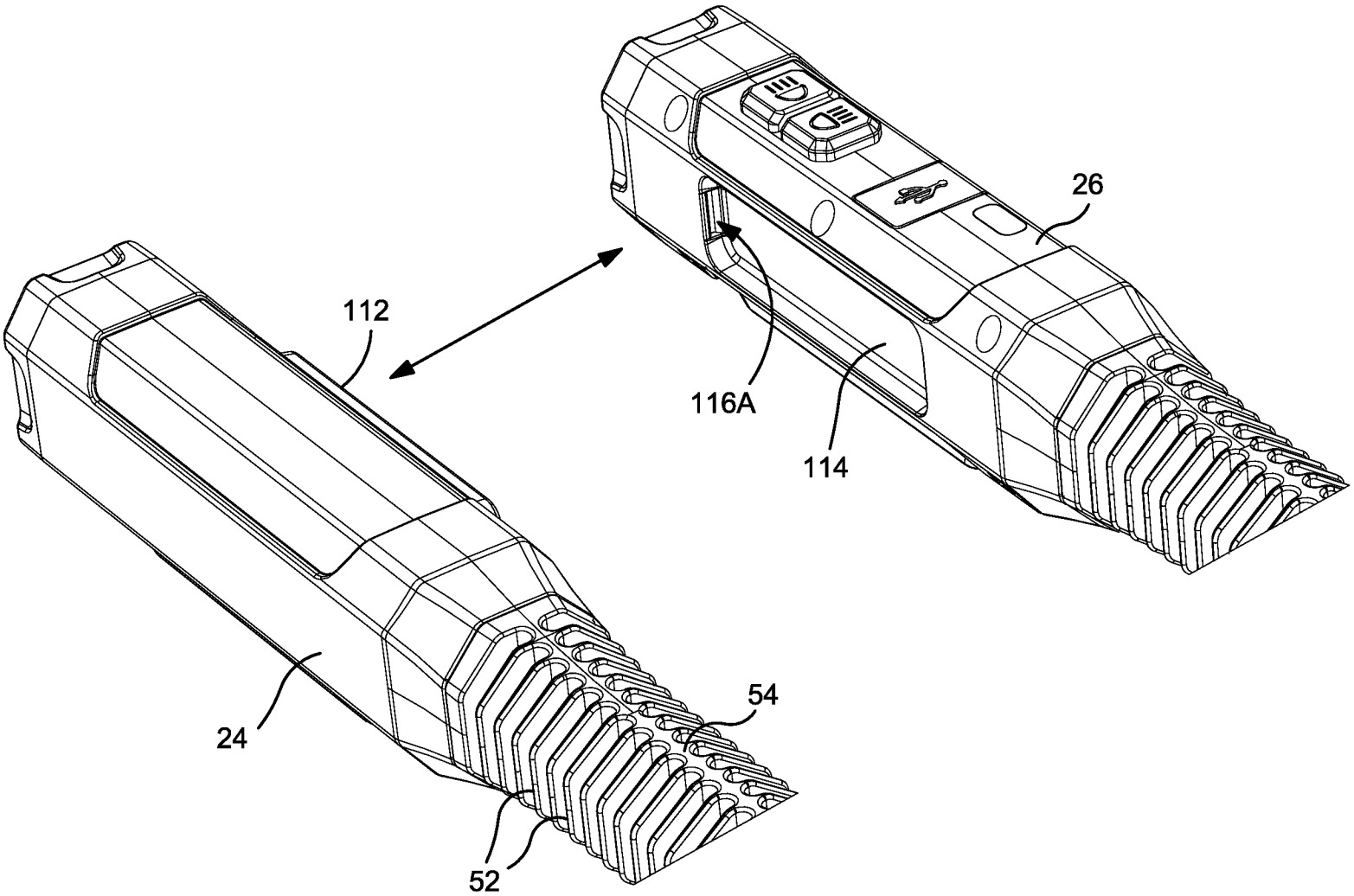
FIG. 14A shows the portable light prior to being placed in a storage position.
Figure 14B:
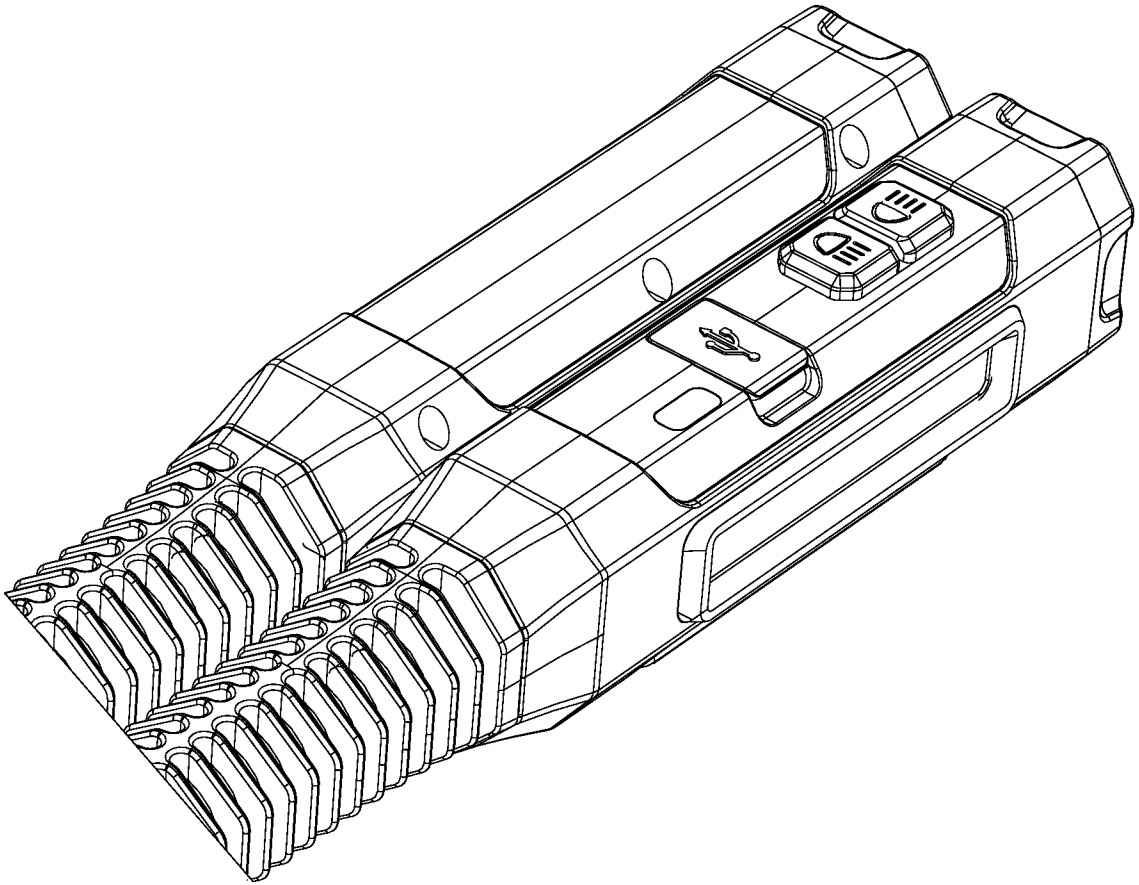
FIG. 14B shows the portable light in a storage position.

When the light is not in use, body members 24 and 26 may be connected to each other as shown in FIGS. 14A and 14B for ease of storage and to reduce the storage space size. Body member 24 includes a snap fit clip 112 which mates with a snap fit clip receptacle 114 in body member 26. The snap fit clip includes spring loaded detents 116 which may be depressed and released by spring 110. Spring loaded detents fit in detent opening 116A of snap fit clip receptacle 114. Instead of a snap fit clip connection, other connection means may be used such as a magnet and metal plug.

In one presently preferred embodiment, the portable light has the following approximate dimensions:

Light Length=22 to 28 inches and preferably 24.5 inches;

Flexible Member Length=12 to 20 inches and preferably 16 inches;

Flexible Member Height=0.75 to 1 inches and preferably 0.85 inches;

Flexible Member Width=0.75 to 1 inches and preferably 0.8 inches;

Body Member Length=3.5 to 5 inches and preferably 4.5 inches;

Body Member Width=1 to 1.5 inches and preferably 1.25 inches;

Body Member Height=1 to 1.5 inches and preferably 1.25 inches.

The over-molded elastomeric material is preferably made of silicone and is molded over the metal coil. The plurality of ribs 52 are spaced apart approximately 0.125 inches and extend outwardly from the tubular member 50 about 0.125 inches. There are preferably 100 ribs. The durometer range for the silicone elastomeric material is 30 A to 90 A, preferably 40 A to 80 A, and most preferably 48 A to 55 A.

In use, light 20 may be wrapped around an object or placed around a user's neck or held by a user or used as a stand alone light, all by adjusting the flexible member 22. The light sources in the body members may be focused on an environment of use by adjusting the body members using the flexible member 22. In operation, switch 74 may be pushed once to turn on the light source in body member 26, pushed a second time to turn on light sources 28 and 30 in both body members 24 and 26, and pushed a third time to turn off the lights. Switch 76 may be pushed to turn on and off light 94 in body member 26. It is understood that one switch may be used to control all of the light sources.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. A portable light for attaching to an object or wearing on a person comprising a flexible member adapted to be attached to the object or to fit around the person's neck and having a first end and second end, the flexible member comprises a flexible wire covered by a tubular elastomeric material wherein the tubular elastomeric material further includes a plurality of flexible ribs extending outwardly from the tubular elastomeric material, a first body member having a light source attached at the first end of the flexible member, a second body member having a light source attached at the second end of the flexible member, and a power source in one of the first or second body members and at least one switch adapted to turn the light sources on and off in the other of the first or second body members, wherein the first and second body members are adapted to move about the flexible member by means of the flexible wire to focus the light sources.

2. The portable light of claim 1 wherein the flexible wire includes a flexible metal coil surrounding the flexible wire.

3. The portable light of claim 1 wherein the tubular elastomeric material includes first and second spine members spaced 180 degrees from each other.

4. The portable light of claim 1 wherein one of the first or second body members includes a further light source in a side wall of the body member.

5. The portable light of claim 1 wherein one of the first or second body members includes a magnet in a bottom wall of the body member adapted to attach the portable light to an object and to adjust the light source in the other of the first and second body members.

6. The portable light of claim 1 wherein the first body member includes a first connection member in an inside side wall of the first body member adapted to connect with a corresponding connection member in the second body member and the second body member includes a second connection member in an inside side wall of the second body member and adapted to connect to the first connection member of the first body member, wherein the first and second connection members connect to hold the first and second body members in a connected position for storage of the portable light.

7. The portable light of claim 6 wherein the first and second connection members are selected from the group consisting of a magnet and a metal plug, and a snap fit closure.

8. The portable light of claim 1 wherein the light sources comprise LED light sources.

9. The portable light of claim 1 wherein the power source comprises a rechargeable battery and having a power level indicator connected thereto.

10. The portable light of claim 9 further comprising a USB port for charging the rechargeable battery.

11. The portable light of claim 1 wherein the flexible wire has a first L-shaped end and a second L-shaped end, the first L-shaped end is adapted to be held in the first body member and the second L-shaped end is adapted to be held in the second body member.

12. The portable light of claim 11 wherein the first and second L-shaped ends are held in place by a wire cap.

13. The portable light of claim 1 wherein the dimensions of the portable light comprise:

Light Length=22 to 28 inches;

Flexible Member Length=12 to 20 inches;

Flexible Member Height=0.75 to 1 inches;

Flexible Member Width=0.75 to 1 inches;

Body Member Length=3.5 to 5 inches;

Body Member Width=1 to 1.5 inches;

Body Member Height=1 to 1.5 inches.

14. The portable light of claim 1 wherein the elastomeric material is silicone.

15. The portable light of claim 14 wherein the elastomeric material is over-molded on the flexible wire.

16. The portable light of claim 1 wherein the elastomeric material has a durometer hardness in the range of 30 A to 90 A.

17. The portable light of claim 14 wherein the elastomeric material has a durometer hardness in the range of 30 A to 90 A.

* * * * *